US010749253B2

(12) United States Patent
Qi et al.

(10) Patent No.: US 10,749,253 B2
(45) Date of Patent: Aug. 18, 2020

(54) OMNIDIRECTIONAL CEILING ANTENNA

(71) Applicant: JIANGSU EAST CENTURY NETWORK INFORMATION CO., LTD., Nanjing (CN)

(72) Inventors: Yihong Qi, Nanjing (CN); Wei Yu, Nanjing (CN)

(73) Assignee: JIANGSU EAST CENTURY NETWORK INFORMATION CO., LTD., Nanjing (CN)

( * ) Notice: Subject to any disclaimer, the term of this patent is extended or adjusted under 35 U.S.C. 154(b) by 235 days.

(21) Appl. No.: 16/062,898

(22) PCT Filed: Feb. 26, 2016

(86) PCT No.: PCT/CN2016/074673

§ 371 (c)(1),
(2) Date: Jun. 15, 2018

(87) PCT Pub. No.: WO2017/101215

PCT Pub. Date: Jun. 22, 2017

(65) Prior Publication Data

US 2018/0366819 A1 Dec. 20, 2018

(30) Foreign Application Priority Data

Dec. 16, 2015 (CN) ..... 2015 1 0945701

(51) Int. Cl.
*H01Q 1/38* (2006.01)
*H01Q 21/28* (2006.01)
(Continued)

(52) U.S. Cl.
CPC ..... *H01Q 1/38* (2013.01); *H01Q 1/007* (2013.01); *H01Q 1/12* (2013.01); *H01Q 1/521* (2013.01);
(Continued)

(58) Field of Classification Search
CPC .. H01Q 1/38; H01Q 1/00; H01Q 1/12; H01Q 1/52; H01Q 9/04; H01Q 9/16; H01Q 21/28
(Continued)

(56) References Cited

U.S. PATENT DOCUMENTS

2015/0009092 A1* 1/2015 Chen ..... H01Q 1/243 343/893

FOREIGN PATENT DOCUMENTS

CN 104103894 A 10/2014

OTHER PUBLICATIONS

ISA/CN, English translation of International Search Report for PCT/CN2016/074673.

* cited by examiner

*Primary Examiner* — Andrea Lindgren Baltzell
(74) *Attorney, Agent, or Firm* — Hodgson Russ LLP

(57) ABSTRACT

Disclosed is an omnidirectional ceiling antenna (10). The omnidirectional ceiling antenna (10) comprises: a base plate (101); a first antenna unit (102) and a second antenna unit (103), the first antenna unit and the second antenna unit are arranged on the base plate at intervals, and the first antenna unit and the second antenna unit are not symmetrical with respect to a longitudinal central axis of the base plate; a coupling plate (104), the coupling plate is arranged on the base plate; an isolation plate (105), the isolation plate is arranged on the base plate; and a first feeding member (106) and a second feeding member (107), the first feeding member cooperates with the first antenna unit so as to feed the first antenna unit, and the second feeding member cooperates with the second antenna unit so as to feed the second antenna unit.

20 Claims, 6 Drawing Sheets

(51) Int. Cl.

| | |
|---|---|
| ***H01Q 9/04*** | (2006.01) |
| ***H01Q 1/00*** | (2006.01) |
| ***H01Q 1/12*** | (2006.01) |
| ***H01Q 1/52*** | (2006.01) |
| ***H01Q 9/16*** | (2006.01) |

(52) U.S. Cl.
CPC ..... *H01Q 9/0421* (2013.01); *H01Q 9/16* (2013.01); *H01Q 21/28* (2013.01)

(58) Field of Classification Search
USPC ..... 343/700 R
See application file for complete search history.

OMNIDIRECTIONAL CEILING ANTENNA

CROSS-REFERENCE TO RELATED APPLICATIONS

This application is a U.S. national phase application of International Patent Application No. PCT/CN2016/074673, filed Feb. 26, 2016, which claims priority to and benefits of Chinese Patent Application No. 201510945701.7, filed Dec. 16, 2015, the entire contents of which are incorporated herein.

FIELD

The present disclosure relates to a field of antennas, and particularly, to an omnidirectional ceiling antenna.

BACKGROUND

In the related art, an omnidirectional ceiling antenna adopts a planar inverted F-shaped antenna (PIFA). The existing omnidirectional ceiling antenna has disadvantages of high noise, low isolation, high correlation, and poor balance of overall performance.

SUMMARY

The present disclosure is based on the inventor's discovery and knowledge of the following facts and problems. In the related art, the existing omnidirectional ceiling antenna includes two PIFA antennas, and because the two PIFA antennas have the same structure and are arranged symmetrically, the omnidirectional ceiling antenna has defects of high noise, low isolation, high correlation, and poor balance of overall performance.

The present disclosure aims to solve at least one of the technical problems in the related art at least to some extent. Accordingly, the present disclosure provides an omnidirectional ceiling antenna that has advantages of low noise, high isolation, low correlation, and well-balanced overall performance.

The omnidirectional ceiling antenna according to embodiments of the present disclosure includes: a base plate; a first antenna unit and a second antenna unit, the first antenna unit and the second antenna unit being arranged on the base plate and spaced apart from each other, and the first antenna unit and the second antenna unit being asymmetrical with respect to a longitudinal central axis of the base plate; a coupling plate, provided on the base plate; an isolation plate, provided on the base plate; and a first feeding member and a second feeding member, the first feeding member cooperating with the first antenna unit to feed the first antenna unit, while the second feeding member cooperating with the second antenna unit to feed the second antenna unit.

The omnidirectional ceiling antenna according to embodiments of the present disclosure has advantages of low noise, high isolation, low correlation, and well-balanced overall performance.

Furthermore, the omnidirectional ceiling antenna according to the above embodiments of the present disclosure can have the following additional technical features.

According to an embodiment of the present disclosure, the base plate includes: a plate body, provided with a first through hole; and a first inclined plate and a second inclined plate, a lower edge of the first inclined plate being connected with a first side edge of the plate body, and the first inclined plate extending upwards from the first side edge and away from the plate body; a lower edge of the second inclined plate being connected with a second side edge of the plate body, and the second inclined plate extending upwards from the second side edge and away from the plate body, in which the first side edge and the second side edge are opposite.

According to an embodiment of the present disclosure, a structure of the first antenna unit is different from a structure of the second antenna unit.

According to an embodiment of the present disclosure, each of the first antenna unit and the second antenna unit includes: a metal plate; at least two metal short dots, an upper edge of each metal short dot being connected with a first edge of the metal plate, while a lower edge of each metal short dot being connected with the base plate; at least one metal branch, an upper edge of the metal branch being connected to a second edge of the metal plate, while a lower edge of the metal branch being spaced apart from the base plate; and at least one metal feeding surface, an upper edge of the metal feeding surface being connected with a third edge of the metal plate, while a lower edge of the metal feeding surface being spaced apart from the base plate, in which the third edge of the metal plate is opposite to the second edge of the metal plate. The structure of the first antenna unit is different from the structure of the second antenna unit by at least one of the following methods. Method A: at least one factor of at least one of the metal plate, the metal short dot, the metal branch and the metal feeding surface of the first antenna unit is different from the same factor(s) of the corresponding at least one of the metal plate, the metal short dot, the metal branch and the metal feeding surface of the second antenna unit, in which the at least one factor includes size, shape, quantity, distance from the base plate, and positions on the first antenna unit and the second antenna unit. Method B: the metal plate of one of the first antenna unit and the second antenna unit is provided with a second through hole. Method C: the metal plate of each of the first antenna unit and the second antenna unit is provided with the second through hole, but at least one of size, shape, and quantity of the second through hole, as well as a position of the second through hole on the first antenna unit or the second antenna unit is different from each other as regards the first antenna unit and the second antenna unit.

According to an embodiment of the present disclosure, the metal plate of one of the first antenna unit and the second antenna unit is provided with the second through hole, and the second through hole has a fractal structure.

According to an embodiment of the present disclosure, at least one corner of the metal plate of the first antenna unit is removed to form at least one notch, and at least one corner of the metal plate of the second antenna unit is removed to form at least one notch.

According to an embodiment of the present disclosure, the first antenna unit and the second antenna unit are asymmetrical with respect to the longitudinal central axis of the base plate by at least one of the following methods. Method A: a distance between the first antenna unit and the base plate in an up-and-down direction is different from a distance between the second antenna unit and the base plate in the up-and-down direction. Method B: a distance between the first antenna unit and a left side edge of the base plate in a left-and-right direction is different from a distance between the second antenna unit and a right side edge of the base plate in the left-and-right direction. Method C: a distance between the first antenna unit and a front edge of the base plate in a front-and-rear direction is different from a distance between the second antenna unit and the front edge of the base plate in the front-and-rear direction. Method D: a distance between the first antenna unit and a rear edge of the base plate in the front-and-rear direction is different from a distance between the second antenna unit and the rear edge of the base plate in the front-and-rear direction.

According to an embodiment of the present disclosure, the isolation plate is adjacent to a middle portion of the base plate, and preferably, a first portion of the isolation plate is located between the first antenna unit and the second antenna unit, while a second portion of the isolation plate is located below an upper surface of the coupling plate.

According to an embodiment of the present disclosure, two isolation plates are provided and spaced apart from each other.

According to an embodiment of the present disclosure, the coupling plate includes: a lower plate, provided on the base plate; a third inclined plate, a lower edge of the third inclined plate being connected with the lower plate, and the third inclined plate extending upwards from the lower plate and in a direction adjacent to a middle portion of the base plate; and an upper plate, connected with an upper edge of the third inclined plate, and connected with the isolation plate.

According to an embodiment of the present disclosure, the third inclined plate is provided with a third through hole, and the third through hole has a fractal structure.

According to an embodiment of the present disclosure, the coupling plate further includes: a first metal plate, an upper edge of the first metal plate being connected with a first edge of the coupling plate, while a lower edge of the first metal plate being spaced apart from the base plate; and a second metal plate, an upper edge of the second metal plate being connected with a second edge of the coupling plate, while a lower edge of the second metal plate being spaced apart from the base plate, in which the first edge of the coupling plate is opposite to the second edge of the coupling plate.

According to an embodiment of the present disclosure, the first feeding member includes a first metal member and a first feeding cable, the first metal member being provided on the base plate, an outer conductor of the first feeding cable being connected with the first metal member, and an inner conductor of the first feeding cable passing through the first metal member and being connected to a metal feeding surface of the first antenna unit; the second feeding member includes a second metal member and a second feeding cable, the second metal member being provided on the base plate, an outer conductor of the second feeding cable being connected with the second metal member, and an inner conductor of the second feeding cable passing through the second metal member and being connected to a metal feeding surface of the second antenna unit.

DETAILED DESCRIPTION

Figure 1:
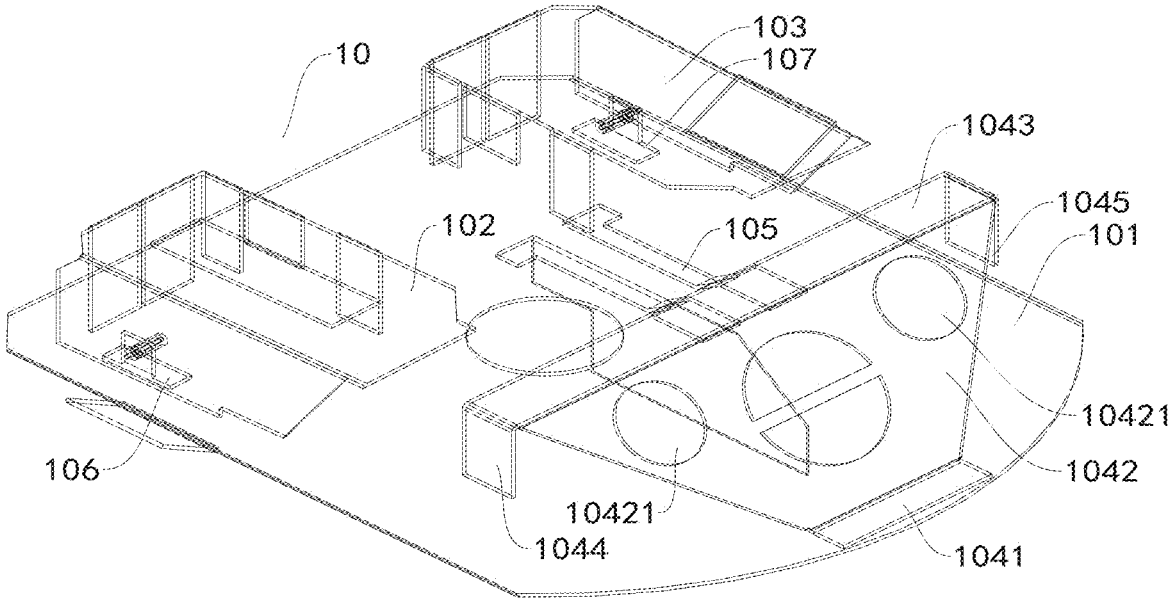
FIG. 1 is a schematic view of an omnidirectional ceiling antenna according to an embodiment of the present disclosure.

Embodiments of the present disclosure will be described in detail, and examples of the embodiments will be shown in accompanying drawings. The following embodiments described with reference to the drawings are exemplary, and are intended to understand the present disclosure rather than limit the scope of the present disclosure.

An omnidirectional ceiling antenna 10 according to embodiments of the present disclosure will be described in below with reference to the drawings. As illustrated in FIGS. 1-12, the omnidirectional ceiling antenna 10 according to embodiments of the present disclosure includes a base plate 101, a first antenna unit 102, a second antenna unit 103, a coupling plate 104, an isolation plate 105, a first feeding member 106, and a second feeding member 107.

The first antenna unit 102 and the second antenna unit 103 are arranged on the base plate 101 and spaced apart from each other. The structure of the first antenna unit 102 is different from that of the second antenna unit 103. The first antenna unit 102 and the second antenna unit 103 are asymmetrical with respect to a longitudinal central axis of the base plate 101. The coupling plate 104 is arranged on the base plate 101, and the isolation plate 105 is arranged on the base plate 101. The first feeding member 106 cooperates with the first antenna unit 102 to feed the first antenna unit 102, while the second feeding member 107 cooperates with the second antenna unit 103 to feed the second antenna unit 103.

For the omnidirectional ceiling antenna 10 according to embodiments of the present disclosure, by arranging the first antenna unit 102 and the second antenna unit 103 in an asymmetrical manner with respect to the longitudinal central axis M of the base plate 101, it is possible to effectively reduce noise of the omnidirectional ceiling antenna 10, increase the passive intermodulation index (PIM index) value of the omnidirectional ceiling antenna 10, improve the isolation degree of the omnidirectional ceiling antenna 10, and reduce the coupling (i.e., improve the degree of isolation between the first antenna unit 102 and the second antenna unit 103, and reduce the coupling between the first antenna unit 102 and the second antenna unit 103), such that the first antenna unit 102 and the second antenna unit 103 have better low correlation, the overall performance of the first antenna unit 102 and the second antenna unit 103 is balanced, and the bandwidth of the omnidirectional ceiling antenna 10 is extended to achieve high gain.

Therefore, the omnidirectional ceiling antenna 10 according to embodiments of the present disclosure has advantages of low noise, high isolation, low correlation, and well-balanced overall performance.

That is, the omnidirectional ceiling antenna 10 according to embodiments of the present disclosure adopts a differentiated dissimilar antenna unit design. The omnidirectional ceiling antenna 10 according to embodiments of the present disclosure can be used in a wide range of applications. For example, the omnidirectional ceiling antenna 10 can be applied to an indoor distribution system of mobile communication to meet the application requirements of 3G- and 4G-LTE indoor distributed antennas.

As illustrated in FIGS. 1-12, the omnidirectional ceiling antenna 10 according to some embodiments of the present disclosure includes the base plate 101, the first antenna unit 102, the second antenna unit 103, the coupling plate 104, the isolation plate 105, the first feeding member 106, and the second feeding member 107.

The base plate 101 may be a metal plate, and the base plate 101 may have a planar structure or a non-planar structure.

As illustrated in FIGS. 1-3 and FIGS. 5-7, the base plate 101 includes a plate body 1011, a first inclined plate 1012, and a second inclined plate 1013. The plate body 1011 is provided with a first through hole 10111, the plate body 1011 may be a flat plate, and the plate body 1011 may be a regular polygon or an irregular polygon.

A lower edge of the first inclined plate 1012 is connected with a first side edge of the plate body 1011, and the first inclined plate 1012 extends upwards from the first side edge and away from the plate body 1011. A lower edge of the second inclined plate 1013 is connected with a second side edge of the plate body 1011, and the second inclined plate 1013 extends upwards from the second side edge and away from the plate body 1011. The first side edge and the second side edge are opposite.

Since the first inclined plate 1012 and the second inclined plate 1013 are provided to the plate body 1011, the standing wave of high frequency can be obviously improved, and the standing wave of low frequency can be improved at the same time. In other words, the first inclined plate 1012 and the second inclined plate 1013 can improve the high-frequency standing wave significantly, and improve the low-frequency standing wave to a certain extent.

Specifically, the lower edge of the first inclined plate 1012 is connected with a left side edge of the plate body 1011, and the first inclined plate 1012 extends upwards and leftwards from the left side edge; the lower edge of the second inclined plate 1013 is connected with a right side edge of the plate body 1011, and the second inclined plate 1013 extends upwards and rightwards from the right side edge.

As illustrated in FIGS. 1-8, FIG. 11, and FIG. 12, each of the first antenna unit 102 and the second antenna unit 103 includes a metal plate 1021, at least two metal short dots 1022, at least one metal branch 1023, and at least one metal feeding surface 1024. The metal plate 1021 may be a flat plate, and the metal plate 1021 may be a regular polygon or an irregular polygon.

An upper edge of each metal short dot 1022 is connected with a first edge of the metal plate 1021, and a lower edge of each metal short dot 1022 is connected with the base plate 101. In other words, the metal plate 102 is located above the base plate 101. Specifically, each metal short dot 1022 may be a metal flat plate, and each metal short dot 1022 may be a regular polygon or an irregular polygon (e.g. a rectangle). The lower edge of each metal short dot 1022 is directly connected with the base plate 101 or is coupled with the base plate 101. By providing at least two metal short dots 1022, the impedance matching of the omnidirectional ceiling antenna 10 can be improved.

An upper edge of the metal branch 1023 is connected to a second edge of the metal plate 1021, and a lower edge of the metal branch 1023 is spaced apart from the base plate 101, that is, the lower edge of the metal branch 1023 is at a certain distance from the base plate 101. The metal branch 1023 may be a metal flat plate, and the metal branch 1023 may be a regular polygon or an irregular polygon (e.g. a rectangle).

An upper edge of the metal feeding surface 1024 is connected with a third edge of the metal plate 1021, and a lower edge of the metal feeding surface 1024 is spaced apart from the base plate 101, that is, the metal feeding surface 1024 is at a certain distance from the base plate 101. The metal feeding surface 1024 may be a metal flat plate, and the metal feeding surface 1024 may be a regular polygon or an irregular polygon.

The third edge of the metal plate 1021 is opposite to the second edge of the metal plate 1021. That is, the metal branch 1023 is arranged opposite to the metal feeding surface 1024. For example, the upper edge of the metal feeding surface 1024 of the first antenna unit 102 is connected with a left side edge of the metal plate 1021, while the upper edge of the metal branch 1023 of the first antenna unit 102 is connected with a right side edge of the metal plate 1021; the upper edge of the metal feeding surface 1024 of the second antenna unit 103 is connected with the right side edge of the metal plate 1021, while the upper edge of the metal branch 1023 of the second antenna unit 103 is connected with the left side edge of the metal plate 1021. The left-and-right direction is as illustrated by arrow A in FIG. 2.

In the existing omnidirectional ceiling antenna, a metal branch is directly connected with a base plate. By spacing the lower edge of the metal branch 1023 from the base plate 101, the frequency point of the omnidirectional ceiling antenna 10 can be increased. In the existing omnidirectional ceiling antenna, a metal feeding surface is directly connected with a base plate. By spacing the lower edge of the metal feeding surface 1024 from the base plate 101, the frequency points of high frequency and low frequency of the omnidirectional ceiling antenna 10 can be effectively adjusted, and the standing wave can be reduced.

Figure 4:
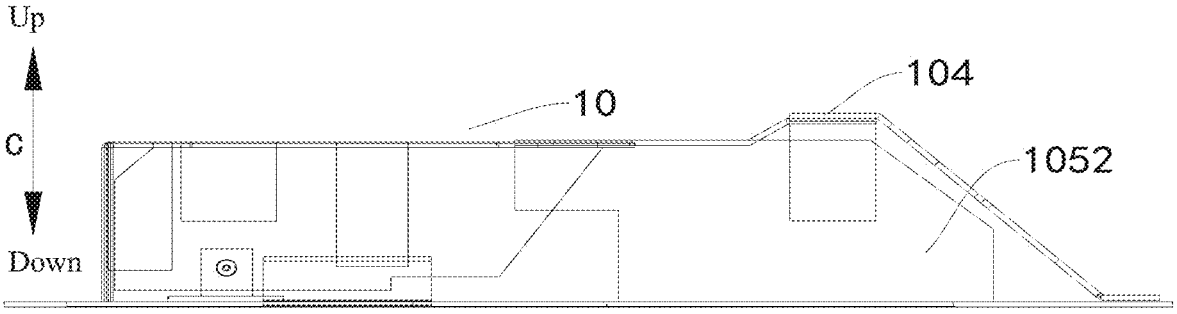
FIG. 4 is a side view of FIG. 1.

As illustrated in FIGS. 1 and 4, the first antenna unit 102 can include two metal short dots 1022, three metal branches 1023, and one metal feeding surface 1024; the second antenna unit 103 can include two metal short dots 1022, three metal branches 1023, and one metal feeding surface 1024.

The structure of the first antenna unit 102 can be completely identical to that of the second antenna unit 103, and the first antenna unit 102 and the second antenna unit 103 are asymmetrical with respect to the longitudinal central axis M of the base plate 101.

In a specific example of the present disclosure, the structure of the first antenna unit 102 is different from that of the second antenna unit 103, and the first antenna unit 102 and the second antenna unit 103 are asymmetrical with respect to the longitudinal central axis M of the base plate 101.

Specifically, at least one of the following methods may be employed in order to make the structure of the first antenna unit 102 different from the structure of the second antenna unit 103.

Method A: at least one factor of at least one of the metal plate 1021, the metal short dot 1022, the metal branch 1023 and the metal feeding surface 1024 of the first antenna unit 102 is different from the same factor(s) of the corresponding at least one of the metal plate 1021, the metal short dot 1022, the metal branch 1023 and the metal feeding surface 1024 of the second antenna unit 103. The at least one factor includes size, shape, quantity, distance from the base plate 101, and positions on the base plate 101, the first antenna unit 102 and the second antenna unit 103.

For example, the first antenna unit 102 includes three metal short dots 1022, while the second antenna unit 103 includes two metal short dots 1022; or the size of the metal plate 1021 of the first antenna unit 102 is larger than the size of the metal plate 1021 of the second antenna unit 103; or the number and shape of the metal branch 1023 of the first antenna unit 102 is different from the number and shape of the metal branch 1023 of the second antenna unit 103, and the number and shape of the metal feeding surface 1024 of the first antenna unit 102 is different from the number and shape of the metal feeding surface 1024 of the second antenna unit 103; or the distance of the metal plate 1021 of the first antenna unit 102 from the base plate 101 in an up-and-down direction is different from the distance of the metal plate 1021 of the second antenna unit 103 from the base plate 101 in the up-and-down direction; or the position of the metal short dot 1022 on the first antenna unit 102 is different from the position of the metal short dot 1022 on the second antenna unit 103. The up-down direction is as illustrated by arrow C in FIG. 4.

Figure 5:
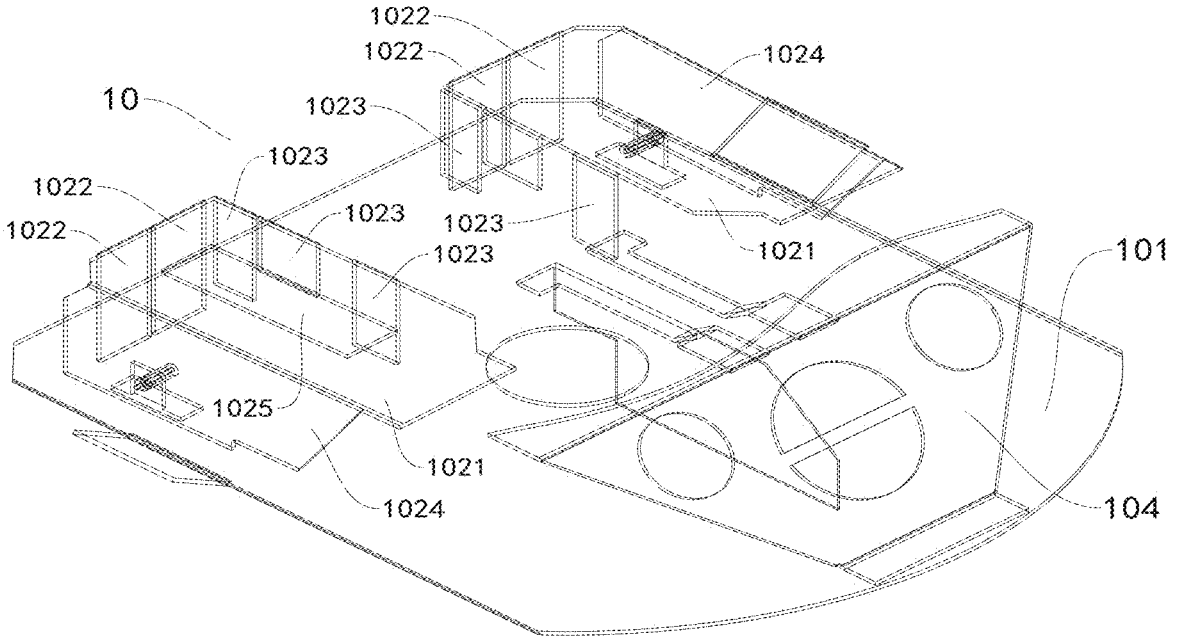
FIG. 5 is a schematic view of an omnidirectional ceiling antenna according to an embodiment of the present disclosure.
Figure 6:
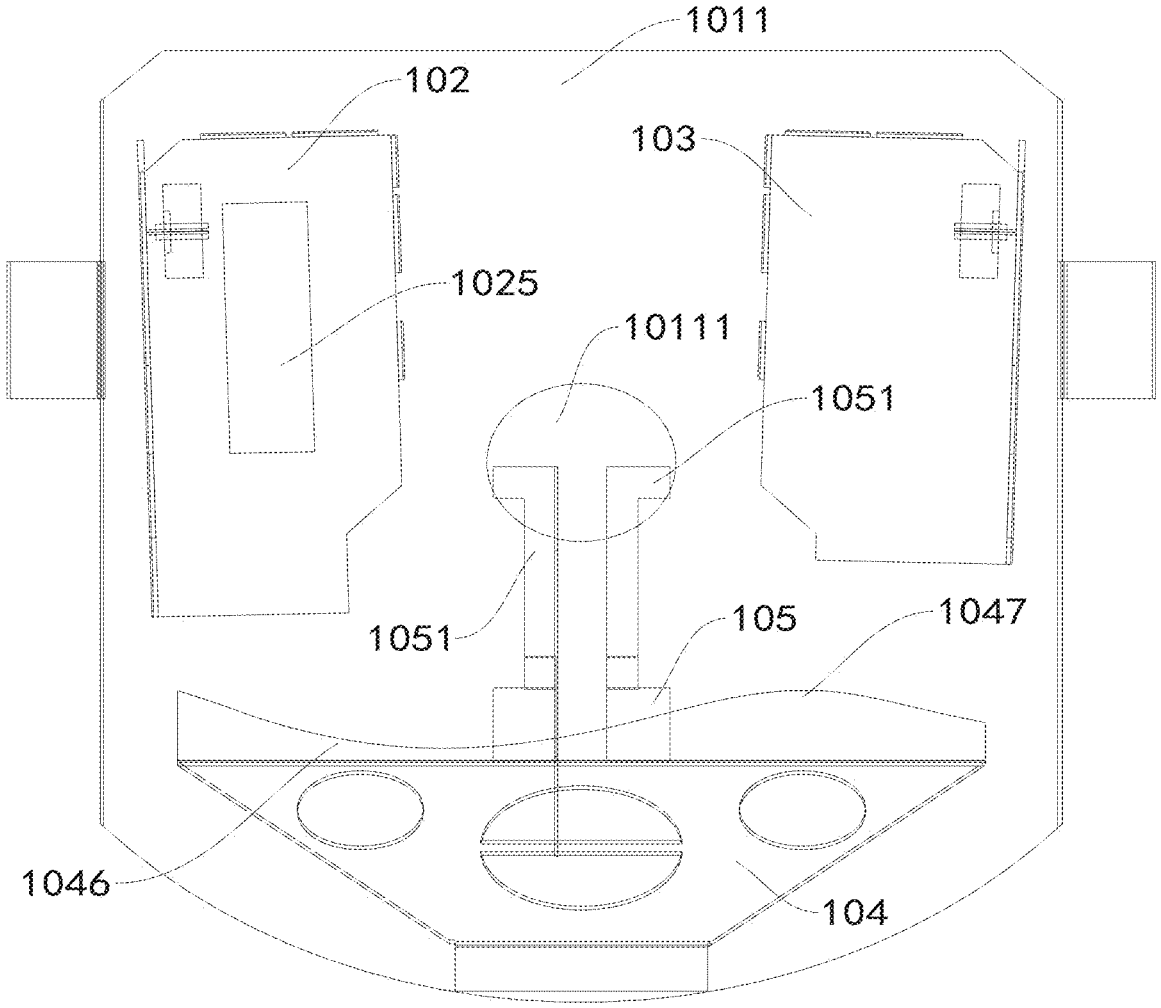
FIG. 6 is a top view of FIG. 5.
Figure 7:
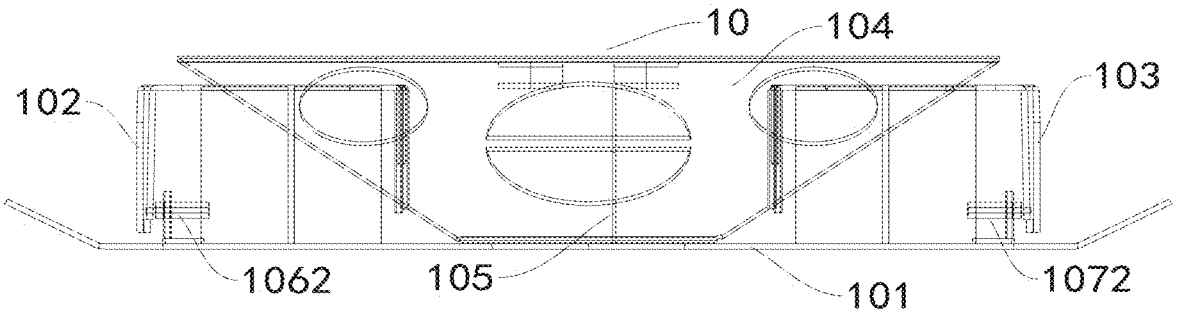
FIG. 7 is a front view of FIG. 5.

As illustrated in FIGS. 5 and 6, in order to adjust the index of the omnidirectional ceiling antenna 10, a portion 1046 of the coupling plate 104 close to the first antenna unit 102 is recessed in a direction away from the first antenna unit 102, while a portion 1047 of the coupling plate 104 close to the second antenna unit 103 protrudes in a direction adjacent to the second antenna unit 103.

In other words, the structure of the first antenna unit 102 is different from that of the second antenna unit 103, and the first antenna unit 102 and the second antenna unit 103 are not symmetrical with respect to the longitudinal central axis M of the base plate 101. Meanwhile, the coupling plate 104 is of a centrally and longitudinally asymmetrical structure either, that is, the coupling plate 104 is not symmetrical with respect to the longitudinal central axis M of the base plate 101. Advantageously, a third through hole 10421 in the coupling plate 104 is not symmetrical with respect to the longitudinal central axis M of the base plate 101 either.

Method B: the metal plate 1021 of one of the first antenna unit 102 and the second antenna unit 103 is provided with a second through hole 1025, that is, the metal plate 1021 of the other one of the first antenna unit 102 and the second antenna unit 103 is not provided with any second through hole 1025.

Method C: the metal plate 1021 of each of the first antenna unit 102 and the second antenna unit 103 is provided with the second through hole 1025, but at least one factor of the size, shape, and quantity of the second through hole 1025, as well as the position of the second through hole 1025 on the first antenna unit or the second antenna unit is different from each other as regards the first antenna unit 102 and the second antenna unit 103.

For example, the first antenna unit 102 is provided with one second through hole 1025, while the second antenna unit 103 is provided with a plurality of second through holes 1025; or the size and shape of the second through hole 1025 in the first antenna unit 102 is different from the size and shape of the second through hole 1025 in the second antenna unit 103; or the position of the second through hole 1025 in the first antenna unit 102 is different from the position of the second through hole 1025 in the second antenna unit 103.

The second through hole 1025 may be a rectangular hole.

Advantageously, the second through hole 1025 has a fractal structure, that is, the second through hole 1025 may be a fractal hole. The fractal structure is a set of structures having some sort of self-similarity (the following material can be referenced: http://wenku.baidu.com/link?url=H3Ffd5QdAAzFBm_Jlz4q9A8nC1wpUI2IjkJzALL7ywk-NN-2Y84vX2Q8WzR9GwtDCwSqUniACog-ONEGcinG-CWgcmJO9Ub_gzZGl2HDBivjK). Since the second through hole 1025 has the fractal structure, the bandwidth of the omnidirectional ceiling antenna 10 can be adjusted effectively.

Figure 2:
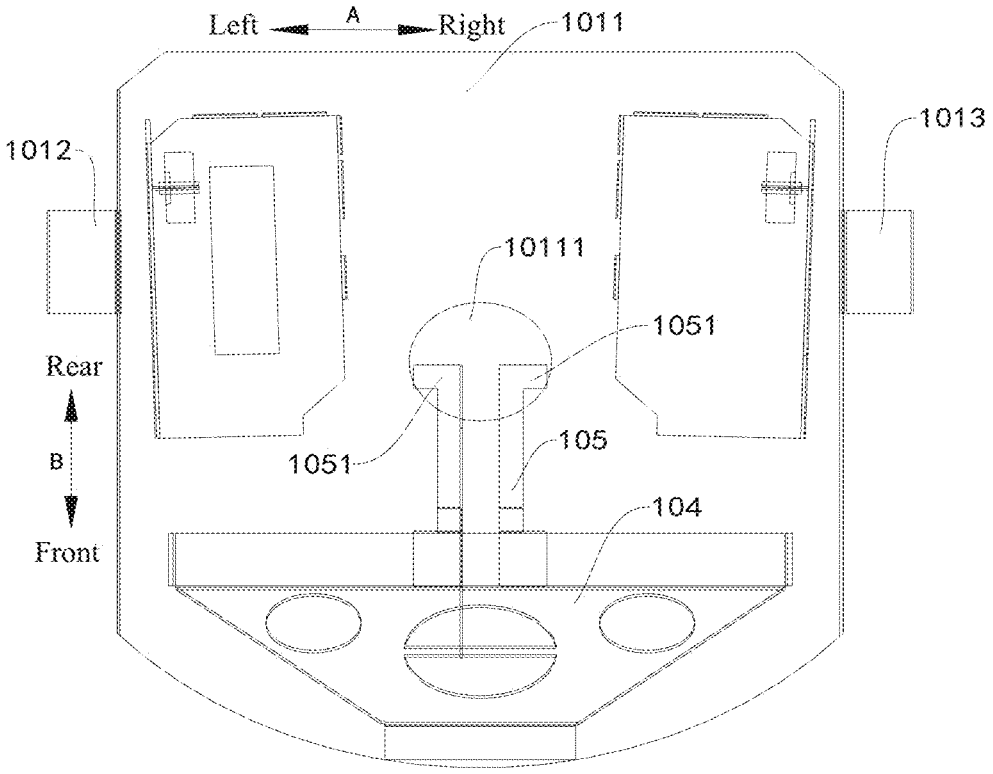
FIG. 2 is a top view of FIG. 1.
Figure 3:
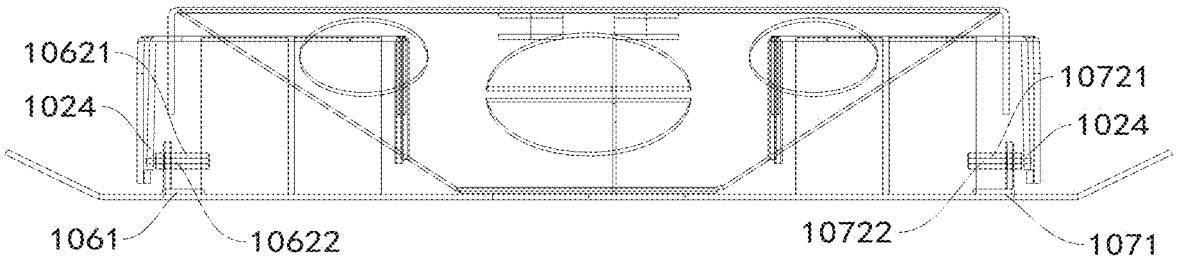
FIG. 3 is a front view of FIG. 1.

As illustrated in FIGS. 2 and 6, at least one corner of the metal plate 1021 of the first antenna unit 102 is removed to form at least one notch, and at least one corner of the metal plate 1021 of the second antenna unit 103 is removed to form at least one notch. As a result, the low-frequency standing wave of the omnidirectional ceiling antenna 10 can be reduced. Advantageously, two corners of each of the metal plate 1021 of the first antenna unit 102 and the metal plate 1021 of the second antenna unit 103 are removed to form two notches.

The first antenna unit 102 and the second antenna unit 103 can be asymmetrical with respect to the longitudinal central axis of the base plate 101 by at least one of the following methods.

Method A: the distance between the first antenna unit 102 and the base plate 101 in the up-and-down direction is different from the distance between the second antenna unit 103 and the base plate 101 in the up-and-down direction. In other words, the distance of at least one component of the first antenna unit 102 from the base plate 101 in the up-and-down direction is different from the distance of the corresponding component of the second antenna unit 103 from the base plate 101 in the up-and-down direction.

Method B: the distance between the first antenna unit 102 and the left side edge of the base plate 101 in the left-and-right direction is different from the distance between the second antenna unit 103 and the right side edge of the base plate 101 in the left-and-right direction. In other words, the distance of at least one component of the first antenna unit 102 from the left side edge of the base plate 101 in the left-and-right direction is different from the distance of the corresponding component of the second antenna unit 103 from the right side edge of the base plate 101 in the left-and-right direction.

Method C: the distance between the first antenna unit 102 and a front edge of the base plate 101 in a front-and-rear direction is different from the distance between the second antenna unit 103 and the front edge of the base plate 101 in the front-and-rear direction. In other words, the distance of at least one component of the first antenna unit 102 from the front edge of the base plate 101 in the front-and-rear direction is different from the distance of the corresponding component of the second antenna unit 103 from the front edge of the base plate 101 in the front-and-rear direction.

Method D: the distance between the first antenna unit 102 and a rear edge of the base plate 101 in the front-and-rear direction is different from the distance between the second antenna unit 103 and the rear edge of the base plate 101 in the front-and-rear direction. In other words, the distance of at least one component of the first antenna unit 102 from the rear edge of the base plate 101 in the front-and-rear direction is different from the distance of the corresponding component of the second antenna unit 103 from the rear edge of the base plate 101 in the front-and-rear direction.

The isolation plate 105 is used to adjust the isolation degree of the omnidirectional ceiling antenna 10. The isolation plate 105 may be a metal member, and the isolation plate 105 may have a planar structure or a non-planar structure.

As illustrated in FIGS. 1, 2, 5 and 6, the isolation plate 105 is provided on the base plate 101, and the isolation plate 105 can be directly connected with the base plate 101 or be coupled with the base plate 101. A first portion 1051 of the isolation plate 105 is located between the first antenna unit 102 and the second antenna unit 103, that is, the first portion 1051 of the isolation plate 105 is located between the first antenna unit 102 and the second antenna unit 103 in the left-and-right direction. Thus, the first antenna unit 102 can be spaced apart from the second antenna unit 103.

A second portion 1052 of the isolation plate 105 is located below an upper surface of the coupling plate 104. Thus, the isolation plate 105 can effectively interact with the coupling plate 104, so that the degree of isolation between the first antenna unit 102 and the second antenna unit 103 can be further increased, and meanwhile, the degree of isolation between low frequency and high frequency of the omnidirectional ceiling antenna 10 can be effectively reduced.

Advantageously, the isolation plate 105 is adjacent to a middle portion of the base plate 101. That is, the isolation plate 105 is adjacent to the middle portion of the base plate 101 in the front-and-rear direction. As a result, the overall length of the omnidirectional ceiling antenna 10 can be reduced, and the volume of the omnidirectional ceiling antenna 10 can be decreased. The front-and-rear direction is as illustrated by arrow B in FIG. 2.

As illustrated in FIGS. 2 and 5, two isolation plates 105 are provided and spaced apart from each other. One isolation plate 105 can be provided, and this isolation plate 105 has a non-planar structure. This isolation plate 105 can be formed by connecting and combining two isolation plates 105.

Advantageously, the second portion 1052 of this isolation plate 105 is located below the upper surface of the coupling plate 104, while a third portion of this isolation plate 105 is located above the coupling plate 104. This isolation plate 105 can be coupled with the coupling plate 104, and can be directly connected with the coupling plate 104.

Figure 10:
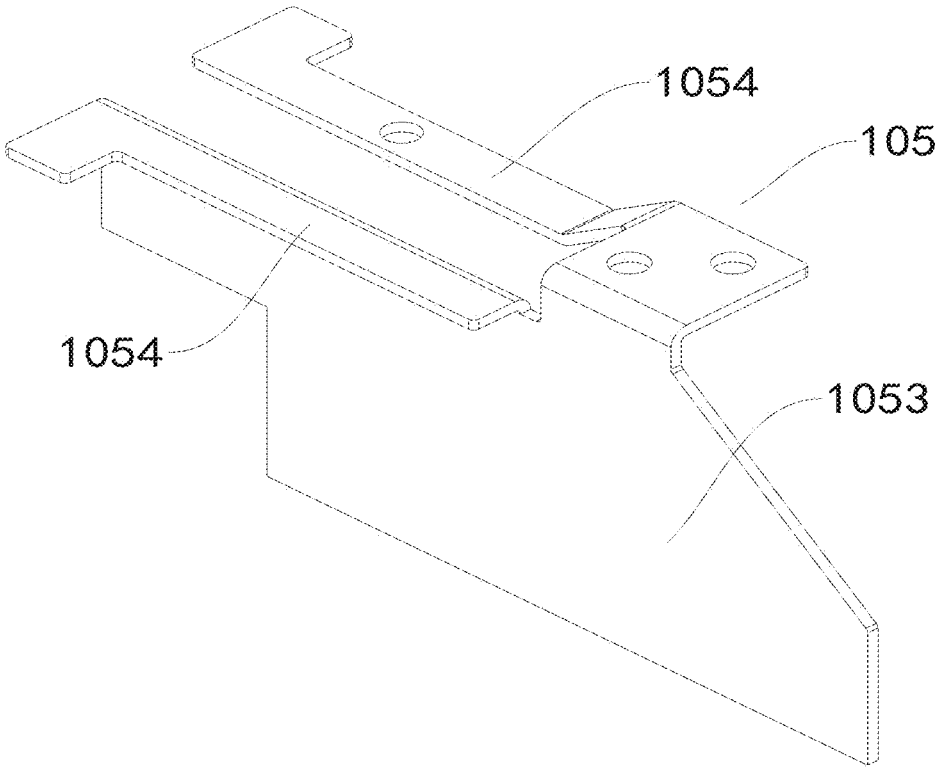
FIG. 10 is a schematic view of an isolation plate of an omnidirectional ceiling antenna according to an embodiment of the present disclosure.
Figure 11:
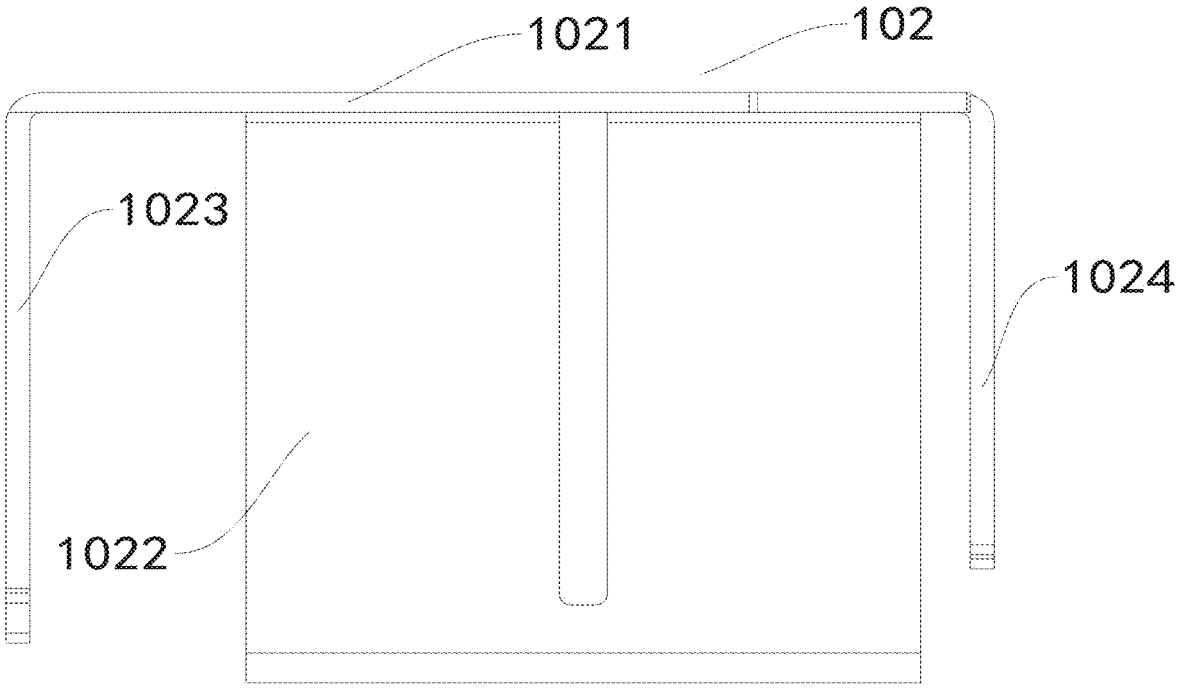
FIG. 11 is a schematic view of a first antenna unit of an omnidirectional ceiling antenna according to an embodiment of the present disclosure.
Figure 12:
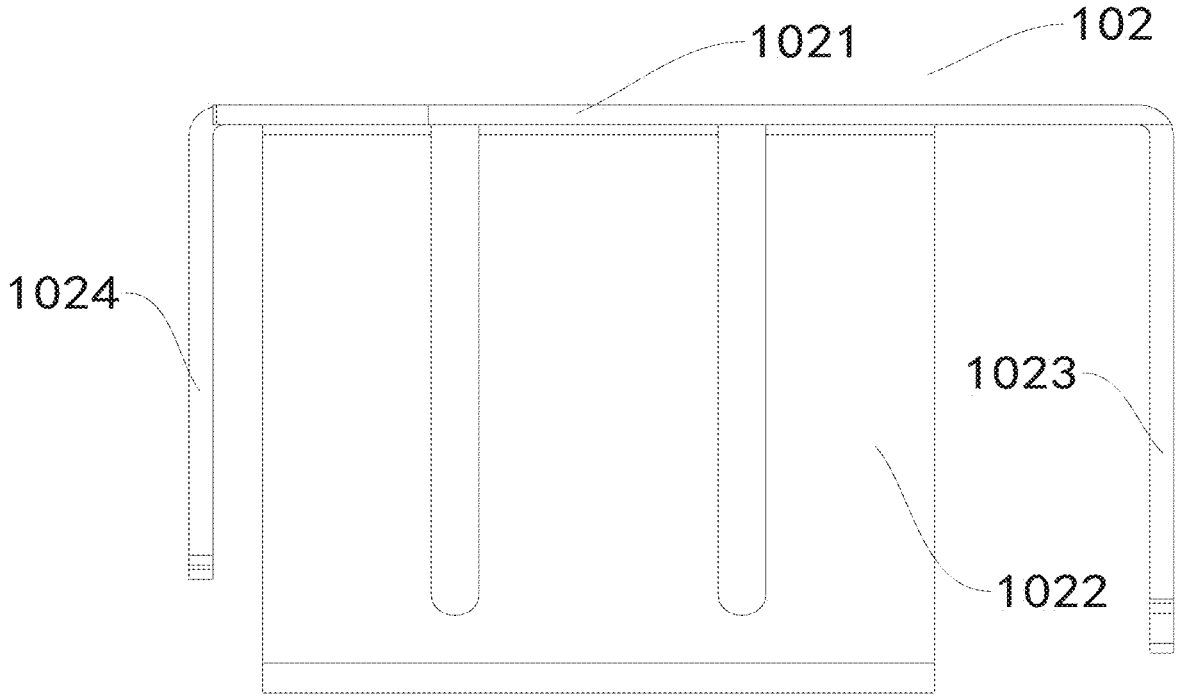
FIG. 12 is a schematic view of a second antenna unit of an omnidirectional ceiling antenna according to an embodiment of the present disclosure.

As illustrated in FIG. 10, the isolation plate 105 includes a first metal plane 1053 of an irregular polygon, and a second metal plane 1054 bent and extending along one edge of the first metal plane 1053.

The coupling plate is used to adjust the standing wave, omnidirectional property, and other indexes of the omnidirectional ceiling antenna 10. The coupling plate 104 can be a metal member, and can have a planar structure or a non-planar structure. Advantageously, the coupling plate 104 can be of a centrally and longitudinally asymmetrical structure.

Figure 8:
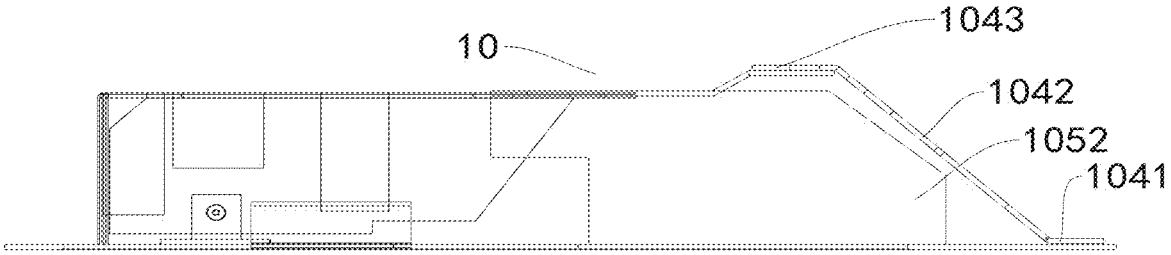
FIG. 8 is a side view of FIG. 5.
Figure 9:
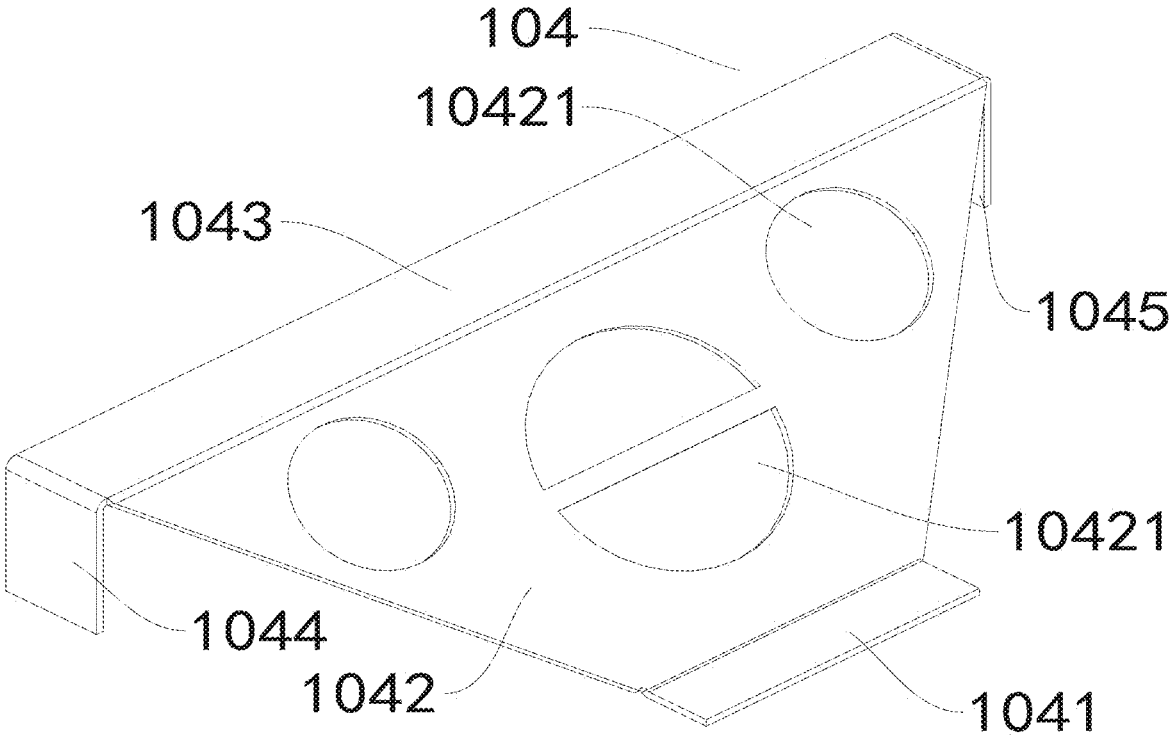
FIG. 9 is a schematic view of a coupling plate of an omnidirectional ceiling antenna according to an embodiment of the present disclosure.

As illustrated in FIGS. 4 and 8, in some examples of the present disclosure, the coupling plate 104 includes a lower plate 1041, a third inclined plate 1042, and an upper plate 1043. The lower plate 1041 is arranged on the base plate 101, and the lower plate 1041 can be directly connected with the base plate 101 or be coupled with the base plate 101. A lower edge of the third inclined plate 1042 is connected with the lower plate 1041, and the third inclined plate 1042 extends upwards from the lower plate 1041 and in a direction adjacent to the middle portion of the base plate 101, in which this middle portion of the base plate 101 is the middle portion of the base plate 101 in the front-and-rear direction. The upper plate 1043 is connected with an upper edge of the third inclined plate 1042, and the upper plate 1043 is connected with the isolation plate 105, in which the second portion 1052 of the isolation plate 105 is located below the upper plate 1043. Specifically, the upper plate 1043 is directly connected with the isolation plate 105 or is coupled with the isolation plate 105.

In other words, the third inclined plate 1042 and the base plate 101 define an included angle. The second portion 1052 of the isolation plate 105 can be located in the included angle defined by the third inclined plate 1042 and the base plate 101.

As illustrated in FIGS. 1 and 2, the third inclined plate 1042 is provided with the third through hole 10421, and the third through hole 10421 has a fractal structure. Advantageously, a plurality of third through holes 10421 can be provided.

In an example of the present disclosure, as illustrated in FIGS. 3, 4, 7 and 8, the coupling plate 104 further includes a first metal plate 1044 and a second metal plate 1045. An upper edge of the first metal plate 1044 is connected with a first edge of the coupling plate 104, and a lower edge of the first metal plate 1044 is spaced apart from the base plate 101. An upper edge of the second metal plate 1045 is connected with a second edge of the coupling plate 104, and a lower edge of the second metal plate 1045 is spaced apart from the base plate 101. The first edge of the coupling plate 104 is opposite to the second edge of the coupling plate 104, that is, the first metal plate 1044 and the second metal plate 1045 can be arranged opposite to each other.

The upper edge of the first metal plate 1044 is connected with a left side edge of the coupling plate 104, while the upper edge of the second metal plate 1045 is connected with a right side edge of the coupling plate 104. Advantageously, each of the first metal plate 1044 and the second metal plate 1045 can be vertically arranged. The coupling plate 104 is asymmetrical with respect to the longitudinal central axis M of the base plate 101.

In the related art, the coupling plate is separately arranged at an edge of one side of the antenna, and the coupling plate is difficult to interact with the isolation plate. The coupling plate 104 of the omnidirectional ceiling antenna 10 according to embodiments of the present disclosure has the following effects. First, through the cooperation of the coupling plate 104 and the isolation plate 105, the degree of isolation between the first antenna unit 102 and the second antenna unit 103 can be improved, and the degree of isolation between low frequency and high frequency of the omnidirectional ceiling antenna 10 can be effectively reduced. Second, the coupling plate 104 has a strong coupling effect on low frequency, and in particular, the first metal plate 1044 and the second metal plate 1045 can adjust low-frequency standing waves and high-frequency standing waves. Third, the third through hole 10421 having the fractal structure and provided in the third inclined plate 1042 can improve the omnidirectional property of the omnidirectional ceiling antenna 10, and reduce the influence on the directional pattern.

The omnidirectional ceiling antenna 10 according to embodiments of the present disclosure can be fed in various suitable ways. As illustrated in FIG. 1, FIGS. 3-5, FIG. 7 and FIG. 8, the first feeding member 106 includes a first metal member 1061 and a first feeding cable 1062, and the first metal member 1061 is provided on the base plate 101. An outer conductor 10621 of the first feeding cable 1062 is connected with the first metal member 1061, and an inner conductor 10622 of the first feeding cable 1062 passes through the first metal member 1061 and is connected to the metal feeding surface 1024 of the first antenna unit 102. The second feeding member 107 includes a second metal member 1071 and a second feeding cable 1072, and the second metal member 1071 is provided on the base plate 101. An outer conductor 10721 of the second feeding cable 1072 is connected with the second metal member 1071, and an inner conductor 10722 of the second feeding cable 1072 passes through the second metal member 1071 and is connected to the metal feeding surface 1024 of the second antenna unit 103.

Specifically, each of the first metal member 1061 and the second metal member 1071 is L-shaped, and a horizontal plate of each of the first metal member 1061 and the second metal member 1071 is arranged on the base plate 101. The outer conductor of the first feeding cable 1062 is connected with a vertical plate of the first metal member 1061, and the outer conductor of the second feeding cable 1072 is connected with a vertical plate of the second metal member 1071.

Advantageously, an insulation layer is provided between the metal short dot 1022 and the base plate 101, between the first metal member 1061 and the base plate 101, between the second metal member 1071 and the base plate 101, between the isolation plate 105 and the base plate 101, as well as between the coupling plate 104 and the base plate 101, in order to form a coupling connection, thereby improving the passive intermodulation index of the omnidirectional ceiling antenna 10.

In the description of the present disclosure, it should be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation as then described or as shown in the drawings under discussion. These terms are only for convenience and simplicity of the description, and do not indicate or imply that the devices or elements referred to must have a particular orientation or be constructed or operated in a particular orientation. Thus, the terms are not constructed to limit the present disclosure.

In addition, terms such as "first" and "second" are used herein for purposes of description and are not intended to indicate or imply relative importance or significance or to imply the number of indicated technical features. Thus, the feature defined with "first" and "second" may explicitly or implicitly comprise one or more of this feature. In the description of the present disclosure, "a plurality of" means two or more than two, unless specified otherwise.

In the present disclosure, unless specified or limited otherwise, the terms "mounted." "connected," "coupled." "fixed" and the like are used broadly, and may be, for example, fixed connections, detachable connections, or integral connections; may also be mechanical or electrical connections; may also be direct connections or indirect connections via intervening structures; may also be inner communications of two elements or mutual interactions of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below." "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the above phrases in various places throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and described, it would be appreciated by those skilled in the art that the above embodiments are explanatory and cannot be construed to limit the present disclosure, and changes, modifications, alternatives, and variations can be made in the embodiments without departing from the scope of the present disclosure.

What is claimed is:

1. An omnidirectional ceiling antenna, comprising:

a base plate;

a first antenna unit and a second antenna unit, the first antenna unit and the second antenna unit being arranged on the base plate and spaced apart from each other, and the first antenna unit and the second antenna unit being asymmetrical with respect to a longitudinal central axis of the base plate;

a coupling plate, provided on the base plate;

an isolation plate, provided on the base plate; and a first feeding member and a second feeding member, the first feeding member cooperating with the first antenna unit to feed the first antenna unit, while the second feeding member cooperating with the second antenna unit to feed the second antenna unit.

2. The omnidirectional ceiling antenna according to claim 1, wherein the base plate comprises:

a plate body, provided with a first through hole; and a first inclined plate and a second inclined plate, a lower edge of the first inclined plate being connected with a first side edge of the plate body, and the first inclined plate extending upwards from the first side edge and away from the plate body; a lower edge of the second inclined plate being connected with a second side edge of the plate body, and the second inclined plate extending upwards from the second side edge and away from the plate body, in which the first side edge and the second side edge are opposite.

3. The omnidirectional ceiling antenna according to claim 1, wherein a structure of the first antenna unit is different from a structure of the second antenna unit.

4. The omnidirectional ceiling antenna according to claim 1, wherein each of the first antenna unit and the second antenna unit comprises:

a metal plate;

at least two metal short dots, an upper edge of each metal short dot being connected with a first edge of the metal plate, while a lower edge of each metal short dot being connected with the base plate;

at least one metal branch, an upper edge of the metal branch being connected to a second edge of the metal plate, while a lower edge of the metal branch being spaced apart from the base plate; and at least one metal feeding surface, an upper edge of the metal feeding surface being connected with a third edge of the metal plate, while a lower edge of the metal feeding surface being spaced apart from the base plate, in which the third edge of the metal plate is opposite to the second edge of the metal plate;

wherein a structure of the first antenna unit is different from a structure of the second antenna unit by at least one of the following methods, method A: at least one factor of at least one of the metal plate, the metal short dot, the metal branch and the metal feeding surface of the first antenna unit is different from the same factor(s) of the corresponding at least one of the metal plate, the metal short dot, the metal branch and the metal feeding surface of the second antenna unit, in which the at least one factor comprises size, shape, quantity, distance from the base plate, and positions on the first antenna unit and the second antenna unit;

method B: the metal plate of one of the first antenna unit and the second antenna unit is provided with a second through hole;

method C: the metal plate of each of the first antenna unit and the second antenna unit is provided with the second through hole, but at least one of size, shape, and quantity of the second through hole, as well as a position of the second through hole on the first antenna unit or the second antenna unit is different from each other as regards the first antenna unit and the second antenna unit.

5. The omnidirectional ceiling antenna according to claim 4, wherein the metal plate of one of the first antenna unit and the second antenna unit is provided with the second through hole, and the second through hole has a fractal structure.

6. The omnidirectional ceiling antenna according to claim 4, wherein at least one corner of the metal plate of the first antenna unit is removed to form at least one notch, and at least one corner of the metal plate of the second antenna unit is removed to form at least one notch.

7. The omnidirectional ceiling antenna according to claim 1, wherein the first antenna unit and the second antenna unit are asymmetrical with respect to the longitudinal central axis of the base plate by at least one of the following methods, method A: a distance between the first antenna unit and the base plate in an up-and-down direction is different from a distance between the second antenna unit and the base plate in the up-and-down direction;

method B: a distance between the first antenna unit and a left side edge of the base plate in a left-and-right direction is different from a distance between the second antenna unit and a right side edge of the base plate in the left-and-right direction;

method C: a distance between the first antenna unit and a front edge of the base plate in a front-and-rear direction is different from a distance between the second antenna unit and the front edge of the base plate in the front-and-rear direction;

method D: a distance between the first antenna unit and a rear edge of the base plate in the front-and-rear direction is different from a distance between the second antenna unit and the rear edge of the base plate in the front-and-rear direction.

8. The omnidirectional ceiling antenna according to claim 1, wherein the isolation plate is adjacent to a middle portion of the base plate, and preferably, a first portion of the isolation plate is located between the first antenna unit and the second antenna unit, while a second portion of the isolation plate is located below an upper surface of the coupling plate.

9. The omnidirectional ceiling antenna according to claim 1, wherein two isolation plates are provided and spaced apart from each other.

10. The omnidirectional ceiling antenna according to claim 1, wherein the coupling plate comprises:

a lower plate, provided on the base plate;

a third inclined plate, a lower edge of the third inclined plate being connected with the lower plate, and the third inclined plate extending upwards from the lower plate and in a direction adjacent to a middle portion of the base plate; and an upper plate, connected with an upper edge of the third inclined plate, and connected with the isolation plate.

11. The omnidirectional ceiling antenna according to claim 10, wherein the third inclined plate is provided with a third through hole, and the third through hole has a fractal structure.

12. The omnidirectional ceiling antenna according to claim 1, wherein the coupling plate further comprises:

a first metal plate, an upper edge of the first metal plate being connected with a first edge of the coupling plate, while a lower edge of the first metal plate being spaced apart from the base plate; and a second metal plate, an upper edge of the second metal plate being connected with a second edge of the coupling plate, while a lower edge of the second metal plate being spaced apart from the base plate, in which the first edge of the coupling plate is opposite to the second edge of the coupling plate.

13. The omnidirectional ceiling antenna according to claim 1, wherein the first feeding member comprises a first metal member and a first feeding cable, the first metal member being provided on the base plate, an outer conductor of the first feeding cable being connected with the first metal member, and an inner conductor of the first feeding cable passing through the first metal member and being connected to a metal feeding surface of the first antenna unit;

the second feeding member comprises a second metal member and a second feeding cable, the second metal member being provided on the base plate, an outer conductor of the second feeding cable being connected with the second metal member, and an inner conductor of the second feeding cable passing through the second metal member and being connected to a metal feeding surface of the second antenna unit.

14. The omnidirectional ceiling antenna according to claim 3, wherein each of the first antenna unit and the second antenna unit comprises:

a metal plate;

at least two metal short dots, an upper edge of each metal short dot being connected with a first edge of the metal plate, while a lower edge of each metal short dot being connected with the base plate;

at least one metal branch, an upper edge of the metal branch being connected to a second edge of the metal plate, while a lower edge of the metal branch being spaced apart from the base plate; and at least one metal feeding surface, an upper edge of the metal feeding surface being connected with a third edge of the metal plate, while a lower edge of the metal feeding surface being spaced apart from the base plate, in which the third edge of the metal plate is opposite to the second edge of the metal plate;

wherein a structure of the first antenna unit is different from a structure of the second antenna unit by at least one of the following methods, method A: at least one factor of at least one of the metal plate, the metal short dot, the metal branch and the metal feeding surface of the first antenna unit is different from the same factor(s) of the corresponding at least one of the metal plate, the metal short dot, the metal branch and the metal feeding surface of the second antenna unit, in which the at least one factor comprises size, shape, quantity, distance from the base plate, and positions on the first antenna unit and the second antenna unit;

method B: the metal plate of one of the first antenna unit and the second antenna unit is provided with a second through hole;

method C: the metal plate of each of the first antenna unit and the second antenna unit is provided with the second through hole, but at least one of size, shape, and quantity of the second through hole, as well as a position of the second through hole on the first antenna unit or the second antenna unit is different from each other as regards the first antenna unit and the second antenna unit.

15. The omnidirectional ceiling antenna according to claim 14, wherein the metal plate of one of the first antenna unit and the second antenna unit is provided with the second through hole, and the second through hole has a fractal structure.

16. The omnidirectional ceiling antenna according to claim 14, wherein at least one corner of the metal plate of the first antenna unit is removed to form at least one notch, and at least one corner of the metal plate of the second antenna unit is removed to form at least one notch.

17. The omnidirectional ceiling antenna according to claim 3, wherein the isolation plate is adjacent to a middle portion of the base plate, and preferably, a first portion of the isolation plate is located between the first antenna unit and the second antenna unit, while a second portion of the isolation plate is located below an upper surface of the coupling plate.

18. The omnidirectional ceiling antenna according to claim 3, wherein two isolation plates are provided and spaced apart from each other.

19. The omnidirectional ceiling antenna according to claim 3, wherein the coupling plate comprises:

a lower plate, provided on the base plate;

a third inclined plate, a lower edge of the third inclined plate being connected with the lower plate, and the third inclined plate extending upwards from the lower plate and in a direction adjacent to a middle portion of the base plate; and an upper plate, connected with an upper edge of the third inclined plate, and connected with the isolation plate.

20. The omnidirectional ceiling antenna according to claim 19, wherein the third inclined plate is provided with a third through hole, and the third through hole has a fractal structure.

* * * * *